United States Patent [19]

Wood

[11] 4,299,014

[45] Nov. 10, 1981

[54] BUCKLE FOR SAFETY BELTS

[75] Inventor: Kenneth H. Wood, Brighton, Australia

[73] Assignee: Moxham Industrial Pty. Ltd., South Melbourne, Australia

[21] Appl. No.: 72,298

[22] Filed: Sep. 4, 1979

[30] Foreign Application Priority Data

Sep. 1, 1978 [AU] Australia ..... PD5779

[51] Int. Cl.[3] ..... A44B 11/10; A44B 11/00

[52] U.S. Cl. ..... 24/197; 24/196

[58] Field of Search ..... 24/196, 171, 197, 181, 24/77 R, 75

[56] References Cited

U.S. PATENT DOCUMENTS 1,514,462 11/1924 Ritter ..... 24/197

2,807,852 10/1957 Rave ..... 24/197

*Primary Examiner*—Alexander Grosz

[57] ABSTRACT

The invention relates to plate type buckles for safety belts of the kind formed of flat webbing and is particularly concerned with such a buckle wherein engagement between the two parts can only occur when the webbing is not twisted in a way which would lead to slipping occurring when a load is applied to the belt. The buckle comprises a main plate which is attached to one end of the belt and a top plate which is slidably attached in a manner allowing adjustment of the working length of the belt. The belt is turned back in a loop around a webbing bar in the top plate and the main plate has an aperture therethrough capable of passing the loop and a slot in each of opposed longitudinally extending sides of said aperture to extend the width of the aperture for facilitating passage of said top plate in edgewise orientation with respect to said main plate. One slot is deeper than the other and the width of the top plate beyond the width of the belt at respective sides of the loop substantially corresponds to the depth of respective slots so that the top plate and loop may pass through in one orientation but not when the belt webbing is twisted through 180°. Means for reducing the possibility of accidental disengagement of the buckle as well as means for reducing belt "creep" are also described.

6 Claims, 5 Drawing Figures

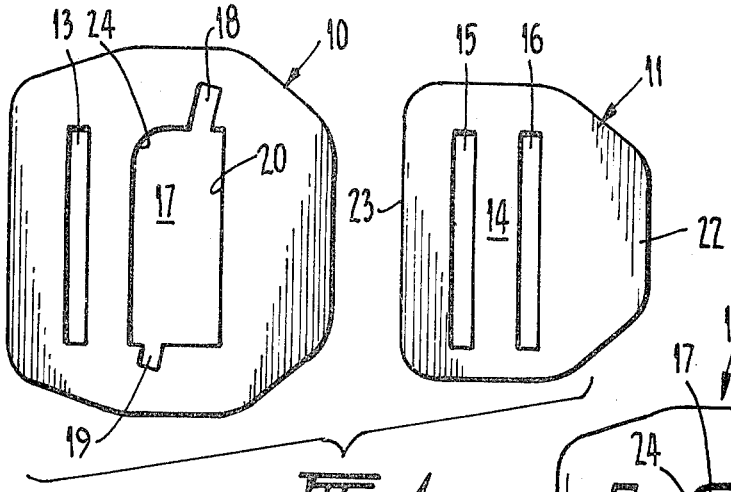
FIG. 1.
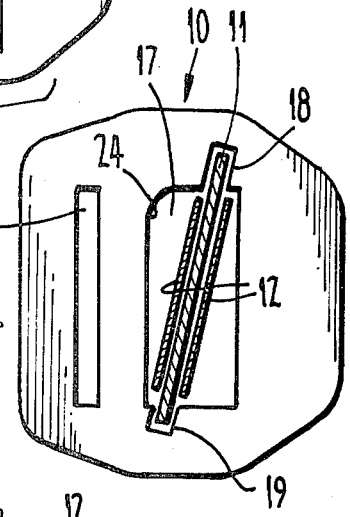
FIG. 2.
FIG. 4.
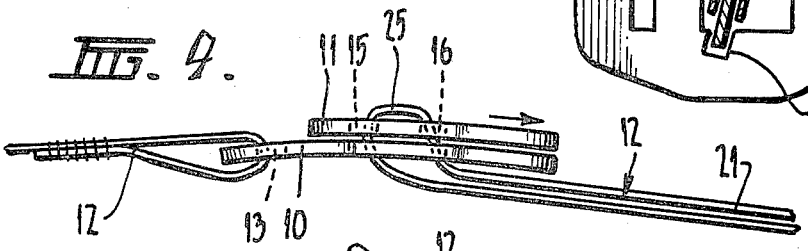
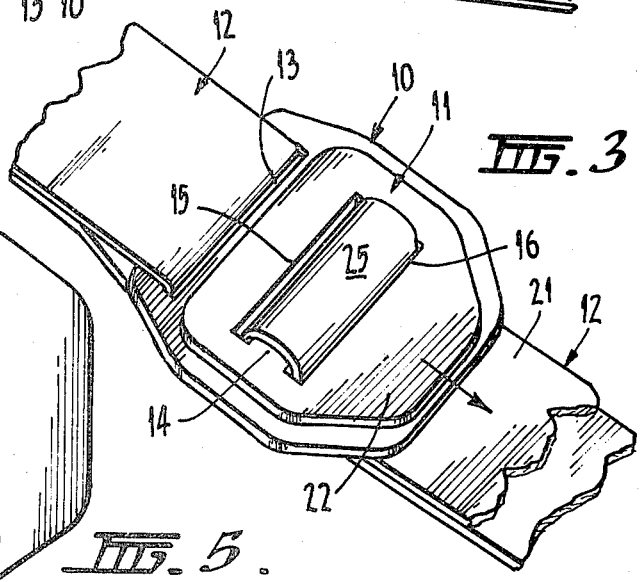
FIG. 3.
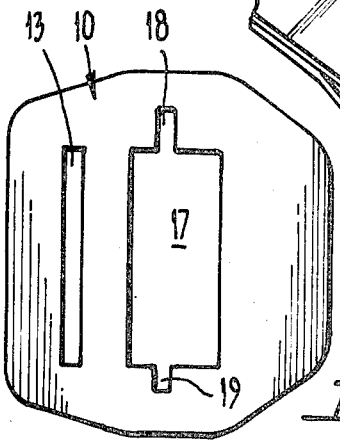
FIG. 5.

BUCKLE FOR SAFETY BELTS

The present invention relates to buckles for safety belts and in particular to plate type buckles as opposed, for example, to buckles of the roller type.

Throughout this specification the term width in relation to a buckle is a dimension in a direction transverse to the length direction of the belt and the term length or longitudinal in relation to a buckle is a dimension in the longitudinal direction of the belt.

Plate type buckles consist essentially of a main plate which is sewn into a loop at one end of the belt and a top plate which is adjustably arranged near the other end of the belt. In connecting the belt around the waist of a user, for example, the top plate is passed through a suitable aperture in the main plate whilst holding the two plates generally in a mutually perpendicular relationship. Once through the aperture, pull on the belt causes the top plate to "sit" flat on top of the main plate on the outside thereof with respect to the user. The aperture in the main plate through which the top plate is passed is conventionally a rectangular aperture having a diagonal dimension which is less than both the length and width of the top plate. Thus in order to facilitate passage of the top plate therethrough conventional buckles of this kind provide notches or slots in opposed sides of the aperture which extend the width of the aperture sufficient to allow passage of the top plate. The slots have a length slightly greater than the thickness of the top plate thus requiring that the top plate be held substantially normal to the main plate for insertion therethrough. The belt is returned back on itself through adjacent apertures in the top plate and is slidable back and forth to facilitate adjustment. The sliding movement in a direction which would lengthen the belt is prevented when the buckle is properly connected and the belt is under load as strain on the belt causes a webbing bar between the apertures of the top plate to jam the belt against a transverse edge of the aperture in the main plate.

Several problems occur with the conventional buckles described above. For example, the belt can be twisted without the user being aware and in this situation the top plate may be accidentally inserted through the main plate in a reverse manner. In this case the free end of the belt is on the inside, that is, adjacent the user, and the load bearing part of the belt is on the outside. Thus under load the belt pulls through the apertures of the top plate as no jamming effect occurs. The belt may therefore slip and the consequences are extremely dangerous.

Another problem with the known buckles can occur in use if one of the transverse edges of the top plate is caught on something and lifted away from the main plate causing the top plate to pivot about the other transverse edge. In certain cases the load on the belt can cause the other edge to slide on the main plate until it is in position to pass through the notches and thus disconnect the buckle.

A still further problem which occurs with the known buckles is belt creep. Belt creep occurs when the load on the belt is removed from time to time during use. The resultant slack in the belt removes the jamming action of the buckle and allows both the load bearing part of the belt and the free end to slide through the top plate in the same direction causing a slack loop. As soon as the load is taken up again the jamming action occurs and the loop is reduced by the load bearing part of the belt pulling through the top plate. This has the effect of slightly increasing the working length of the belt and can occur without the knowledge of the user. If the working length of the belt increases too much without the user's knowledge the belt may slip out of position on the user with dangerous consequences.

Accordingly, it is an object of this invention to provide an improved plate type buckle for safety belts which avoids, or at least reduces, one or more of the aforementioned problems.

According to the invention there is provided a plate type buckle for a safety belt of the kind formed of flat webbing, said buckle comprising a main plate which is attached to one end of the belt and a top plate which is slidably attached in a manner allowing adjustment of the working length of the belt, said belt being turned back in a loop around a webbing bar formed between adjacent apertures in said top plate to facilitate said adjustment, said main plate having an aperture therethrough capable of passing said loop and a slot in each of opposed longitudinally extending sides of said aperture to extend the width thereof for facilitating passage of said top plate in edgewise orientation with respect to said main plate, one slot being deeper than the other and the width of the top plate beyond the width of the belt at respective sides of said loop substantially corresponding to the depth of respective said slots so that said top plate and loop may pass through said main plate aperture when said webbing is not twisted but are prevented from passing therethrough when said webbing is twisted through 180°.

In order that the invention may be more readily understood particular embodiments thereof will now be described with reference to the accompanying drawings wherein:

FIG. 1 is a front view of a main plate and top plate for providing a buckle according to one embodiment of the invention, FIG. 2 is a front view of the main plate of FIG. 1 showing the top plate being inserted therethrough, FIG. 3 is a perspective view of the buckle formed from the components shown in FIGS. 1 and 2 shown in position on a safety belt, FIG. 4 is a side elevation of the buckle shown in FIG. 3 and FIG. 5 is a front view of a further embodiment of the main plate.

Referring now to FIG. 1 the buckle is shown to comprise a main plate 10 and a top plate 11. Both plates are adapted for attachment to a flat webbing in the form of a polyester webbing suitable for safety belts. One end of the webbing 12 (FIG. 3) is inserted through a first aperture 13 in the main plate 10 and is sewn back onto the webbing in a loop retaining the main plate 10. Thus the main plate 10 is permanently fixed in position at one end of the belt.

The top plate 11 is arranged towards the other end of the belt and is mounted on the belt to be slid therealong providing adjustment for the working length of the belt. The top plate 11 has a webbing bar 14 formed between two transversely extending apertures 15 and 16 respectively. The adjustable end of the belt is passed through the aperture 15 and is then turned back on itself around the webbing bar 14 and through the aperture 16. The belt may be slid through the apertures 15 and 16 to provide adjustment of the working length of the belt except when the buckle is attached and the belt is under load as will be apparent hereinbelow.

The main plate 10 has an aperture 17 for receiving the top plate 11 with belt attached. The aperture 17 has a generally rectangular portion which enables passage of the looped part of the belt, that is, the part which is looped around the webbing bar 14. The rectangular part of aperture 17 has its longitudinal dimension extending in a direction transverse of the longitudinal direction of the belt. The opposed longitudinally extending sides of the aperture 17 have respective notches or slots 18 and 19. The notches 18 and 19 extend the transverse width of the aperture 17 to facilitate passage of the top plate 11. In order for the top plate 11 to pass through the aperture 17 of the main plate it is necessary to hold the two plates in a substantially mutually perpendicular relationship. As will be apparent from the drawings the slot 18 has a greater depth than the slot 19 and furthermore the width of the top plate 11 beyond the apertures 15 and 16 is greater on one side of the top plate than the other. Thus it is evident that the top plate 11 can only be inserted through the aperture 17 of the main plate when the widest side of the top plate is arranged in the slot 18; otherwise the looped webbing around the bar 14 will not align with the generally rectangular part of the aperture 17. In this latter situation the top plate 14 cannot be passed through the main plate to attach the buckle.

The operation of the buckle will be evident to those skilled in the art. Once the buckle is attached as shown in FIGS. 3 and 4, tension on the belt causes the looped portion around the webbing bar 14 to pull the webbing bar and hence the top plate 11 in the direction of the arrows shown in FIGS. 3 and 4. This pull causes the webbing bar to jam the webbing between the bar 14 and the front edge 20 of the main plate 10. This jamming effect prevents slipping of the belt in a direction which would cause an increase in the working length of the belt when the belt is under tension. In order to reduce the working length of the belt it is necessary to pull the free end of the belt, that is, the adjusting flap 21, at the same time removing at least some of the tension in the belt. Preferably the top plate 11 is held in a plane at right angles to the direction of the webbing to facilitate adjustment.

As persons skilled in the art will be well aware, insertion of the top plate 11 through the main plate 10 in the incorrect manner has serious consequences. In other words, should the webbing be twisted through 180° the adjusting flap 21 will be on the inside against the user and the working part of the belt will be on the outside away from the user. In this situation the working part of the belt assumes the role of an adjusting flap and tension thereon causes the belt to slip. According to the buckle of the present invention it is impossible to connect the buckle with the belt twisted through 180° and therefore the consequences of an incorrectly attached buckle no longer apply.

As will be noted from FIGS. 1 and 2 the slots 18 and 19 are offset with respect to each other in the longitudinal direction of the belt. This offset or inclination to the longitudinal direction of the belt provides a further feature whereby the buckle cannot become accidentally disconnected due to pivoting of the top plate 11. For example, it can occur that the nose portion 22 of the top plate 11 can be caught on an obstruction and lifted away from the main plate 10 when the belt is in use. This causes the top plate 11 to pivot about the rearward edge 23 and the strain on the belt causes the rearward edge 23 to slide over the main plate towards the slots 18 and 19. However, the rear edge 23 becomes caught in the slot 19 and further sliding movement is prevented. In this position the other side of the top plate 11 is not in alignment with the slot 18 and thus the buckle cannot become detached. Referring to FIG. 5 there is shown an alternative form of the main plate 10 wherein the slots 18 and 19 are in alignment transversely of the longitudinal direction of the belt and thus this additional advantage is not provided The main plate 10 shown in FIG. 5 does of course have the advantage that it cannot be incorrectly connected with a top plate 11 and thus it does incorporate the main feature of the invention. In a further form (not shown) the slots 18 and 19 are offset as in FIGS. 1 and 2 but the angle of inclination of the respective slots with respect to the longitudinal direction of the belt differs slightly such that more precise orientation of the top plate is required to facilitate passage through the main plate and thus the possibility of accidental disengagement is further reduced.

A further subsidiary feature of the invention is evident in FIGS. 1 and 2. It will be noted that one of the corners of the aperture 17 of the main plate 10 has a rounded portion 24. This rounded portion 24 serves to remove or at least reduce the possibility of belt "creep". As will be apparent to persons skilled in the art belt creep occurs when the looped portion 25 (FIG. 4) moves away from the webbing bar 14 due to a release of the tension in the belt. During this movement both the working part of the belt and the adjusting flap 21 slide through the respective apertures 15 and 16. Once the tension is restored to the working part of the belt the top plate slides into position to jam the belt between the bar 14 and the front edge 20 of the main plate. Thus any loop in the belt at 25 is reduced by the belt sliding through the aperture 15. As a consequence the working length of the belt is slightly increased. The rounded portion 24 serves to prevent the belt sliding through the aperture 15 when the tension is released as the belt webbing catches on the rounded portion 24. Thus the buckle shown in the FIGS. 1–4 has the additional feature that it prevents or at least reduces belt creep. The belt described hereinabove may incorporate a position adjuster arranged around the belt and adjusting flap 21 to hold the adjusting flap 21 against the working part of the belt and enable the user to readily adjust the belt to the desired position.

I claim:

1. A plate type buckle for a safety belt of the kind formed of flat webbing, said buckle comprising a main plate which is attached to one end of the belt and a top plate which is slidably attached in a manner allowing adjustment of the working length of the belt, said belt being turned back in a loop around a webbing bar formed between adjacent apertures in said top plate to facilitate said adjustment, said main plate having an aperture therethrough capable of passing said loop and a slot in each of opposed longitudinally extending sides of said aperture to extend the width thereof for facilitating passage of said top plate in edgewise orientation with respect to said main plate, one slot being deeper than the other and the width of the top plate beyond the width of the belt at respective sides of said loop being greater on the one side than on the other to thereby substantially correspond to the depth of respective ones of said slots so that said top plate and loop may pass through said main plate aperture when said webbing is not twisted but are prevented from passing therethrough when said webbing is twisted through 180°.

2. A plate type buckle as defined in claim 1 wherein said slots are offset with respect to each other, in the longitudinal direction of said belt so as to substantially reduce the possibility of accidental opening of said buckle in use.

3. A plate type buckle as defined in claim 2 wherein said slots are in longitudinal alignment along a line extending transverse to the longitudinal direction of said belt, which line is inclined to said longitudinal direction so as to produce said offset.

4. A plate type buckle as defined in claim 2 wherein said slots are in slight longitudinal misalignment along a line extending transverse to the longitudinal direction of said belt and inclined to said longitudinal direction, whereby precise edgewise orientation is required to enable said top plate and loop to pass therethrough whereby the possibility of accidental opening of said buckle in use is further reduced.

5. A plate type buckle as defined in claim 1 wherein said aperture in said main plate is a generally rectangular aperture having its longest dimension extending transversely of the longitudinal dimension of said belt, one longitudinal side of said aperture co-operating with said webbing bar in use to jam said belt webbing when said belt is under tension, the other longitudinal side of said main plate aperture being curved at one corner to at least reduce the occurrence of belt "creep" when said tension is removed and restored.

6. A plate type buckle as defined in claim 5 wherein said plates are correspondingly curved slightly in the longitudinal direction of the belt to more closely follow the body curvature of the user when said belt is used as a waist type belt.

* * * * *